US009693914B2

(12) United States Patent
Ooyama

(10) Patent No.: US 9,693,914 B2
(45) Date of Patent: Jul. 4, 2017

(54) WHEELCHAIR

(71) Applicant: FRANCE BED CO., LTD., Akishima-shi, Tokyo (JP)

(72) Inventor: Kei Ooyama, Akishima (JP)

(73) Assignee: FRANCE BED CO., LTD. (JP)

( * ) Notice: Subject to any disclaimer, the term of this patent is extended or adjusted under 35 U.S.C. 154(b) by 0 days.

(21) Appl. No.: 15/042,640

(22) Filed: Feb. 12, 2016

(65) Prior Publication Data

US 2016/0220432 A1 Aug. 4, 2016

Related U.S. Application Data

(63) Continuation of application No. PCT/JP2015/075470, filed on Sep. 8, 2015.

(30) Foreign Application Priority Data

Jan. 29, 2015 (JP) ..... 2015-014960
May 8, 2015 (JP) ..... 2015-095407
May 8, 2015 (JP) ..... 2015-095408

(51) Int. Cl.
*A61G 5/10* (2006.01)
*A61G 5/14* (2006.01)
(Continued)

(52) U.S. Cl.
CPC ..... *A61G 5/1021* (2013.01); *A61G 5/02* (2013.01); *A61G 5/101* (2013.01); *A61G 5/1018* (2013.01);
(Continued)

(58) Field of Classification Search
CPC .... A61G 5/1035; A61G 5/101; A61G 5/1018; A61G 5/1029; A61G 5/1005; A61G 5/1013; A61G 5/1016
See application file for complete search history.

(56) References Cited

U.S. PATENT DOCUMENTS 5,203,433 A 4/1993 Dugas
5,513,867 A * 5/1996 Bloswick ..... A61G 5/14 280/250.1
(Continued)

FOREIGN PATENT DOCUMENTS

CN 102652008 B 12/2014
JP H07-275295 A 10/1995
(Continued)

OTHER PUBLICATIONS

Notification Concerning Availability of the Publication of International Application and International Search Report for PCT/JP2015-075470 (published under WO2016-121158) mailed on Aug. 4, 2016 from the International Bureau of WIPO (4 pages).
(Continued)

*Primary Examiner* — Kevin Hurley
(74) *Attorney, Agent, or Firm* — Harness, Dickey & Pierce, P.L.C.

(57) ABSTRACT

There are provided a rear wheel rotatably provided in a body, a seat disposed on a top surface side of the body, a seat link mechanism by which the seat is supported to be movable up and down between a raised position and a lowered position on the top surface side of the body, and a brake mechanism which inhibits the rear wheel from rotating in interlock with the seat link mechanism, when the seat is raised from the lowered position to the raised position.

10 Claims, 8 Drawing Sheets

(51) Int. Cl.
*A61G 5/02* (2006.01)
*A61G 5/12* (2006.01)

(52) U.S. Cl.
CPC ..... *A61G 5/1035* (2013.01); *A61G 5/1054* (2016.11); *A61G 5/1059* (2013.01); *A61G 5/128* (2016.11); *A61G 5/14* (2013.01)

(56) References Cited

U.S. PATENT DOCUMENTS

| | | | | |
|---|---|---|---|---|
| 5,894,912 | A * | 4/1999 | Dobben | A61G 5/1037 188/2 F |
| 6,454,285 | B1 * | 9/2002 | Koenig | A61G 5/14 188/2 F |
| 7,434,824 | B2 * | 10/2008 | Connors | A61G 5/1029 188/109 |
| 8,876,138 | B2 | 11/2014 | Wilde | |
| 2008/0133089 | A1 | 6/2008 | Bayomy et al. | |
| 2012/0241265 | A1 * | 9/2012 | Ooyama | A61G 5/1018 188/2 F |

FOREIGN PATENT DOCUMENTS

| | | | |
|---|---|---|---|
| JP | H07-045003 | U | 12/1995 |
| JP | 2006-204606 | A | 8/2006 |
| JP | 2006-320483 | A | 11/2006 |
| JP | 2007-020810 | A | 2/2007 |
| JP | 2008-154978 | A | 7/2008 |
| JP | 2009-072591 | A | 4/2009 |
| JP | 3155886 | U | 12/2009 |
| JP | 2011-056228 | A | 3/2011 |
| JP | 3173273 | U | 2/2012 |
| JP | 2012-125545 | A | 7/2012 |
| TW | 366282 | B | 8/1999 |
| TW | 201121529 | A | 7/2011 |
| TW | 201223515 | A | 6/2012 |

OTHER PUBLICATIONS

Office Action issued in corresponding Taiwan Application No. 105120822 mailed on Apr. 5, 2017 (with English translation) (6 pages).

* cited by examiner

WHEELCHAIR

CROSS REFERENCE TO RELATED APPLICATIONS

This application is a Continuation Application of PCT Application No. PCT/JP2015/075470, filed Sep. 8, 2015 and based upon and claiming the benefit of priority from prior Japanese Patent Applications No. 2015-014960, filed Jan. 29, 2015; No. 2015-095407, filed May 8, 2015; and No. 2015-095408, filed May 8, 2015, the entire contents of all of which are incorporated herein by reference.

BACKGROUND OF THE INVENTION

1. Field of the Invention

The present invention relates to a wheelchair having the function of assisting a sitting user in standing up.

2. Description of the Related Art

In the case of wheelchairs, which are often used by users unable to use their legs, feet, and waists properly, such as the elderly, it is inconvenient that the users cannot stand by themselves from a state in which they sit in the wheelchairs, unless they receive assistance from helpers. In addition, even if the users are assisted by the helpers, it is preferable that a load imposed on the users be smaller.

Thus, there has been recently proposed a wheelchair which allows a sitting user to stand up with relative ease.

Specifically, the wheelchair comprises a body, and a seat in which the user sits is mounted on a top surface side of the body, such that the seat can rotate and rise with its front end functioning as a fulcrum. By stepping on a pedal provided at the lower part of the front or back of the body, the seat can be rotated, such that its back end side rises with its front end functioning as a fulcrum via a link mechanism.

Therefore, when a user stands up, if the user or a helper steps on the pedal, the seat is raised while rotating with its front end functioning as a fulcrum, and pushes up the user's buttocks. Thus, the user can stand up with relative ease.

CITATION LIST

Patent Literature

Patent Document 1: JP 2008-154978 A
Patent Document 2: JP 2011-056228 A

BRIEF SUMMARY OF THE INVENTION

Problem to be Solved by the Invention

Incidentally, according to the wheelchair having the above-described structure, the user sitting in the seat stands up, grasping an armrest provided in the wheelchair to stand up with his or her body steady.

By grasping the armrest to stand, the user can maintain a pose assumed when he or she stand, even if his or her legs, feet, and waist are unsteady. Therefore, the user can stand up with stability.

It should be noted that, when the user stands up from the seat, the wheels of the wheelchair are usually free to rotate. Thus, when the user grasps the armrest of the wheelchair to stand, the wheels may rotate and the wheelchair may move. Such a case is undesirable, as the user's pose becomes unsteady.

As described above, the wheelchair is provided with foot brakes comprising pedals. Therefore, if the user applies the brakes by stepping on the pedals when standing, the wheelchair is prevented from moving, and thus, the user can stand with stability, grasping the armrest.

However, if there is no helper, or if the user needs to be assisted by a helper in standing, it may not be possible to apply the brakes or applying the brakes may be overlooked. If so, when the user grasps the armrest to stand, the wheelchair may move, so that the user's pose becomes unstable.

The present invention provides a wheelchair which enables a user to stand up with stability by causing wheels to be automatically braked when the user stands up from a seat.

Means for Solving Problem

The present invention is a wheelchair comprising:

a main body; a wheel rotatably provided in the main body; a seat disposed on a top surface side of the main body; a seat link mechanism by which the seat is supported to be movable up and down between a raised position and a lowered position on the top surface side of the main body; and a brake mechanism which inhibits the wheel from rotating in interlock with the seat link mechanism, when the seat is raised from the lowered position to the raised position.

Effect of the Invention

According to the present invention, when the user stands up and the seat rises, the wheel is automatically braked in interlock with the rising motion of the seat. Therefore, the user can be prevented from becoming unstable by a movement of the wheelchair made when the user stands up.

DETAILED DESCRIPTION OF THE INVENTION

Embodiments of the present invention will be described hereinafter with reference to the accompanying drawings.

(First Embodiment)

Figure 1:
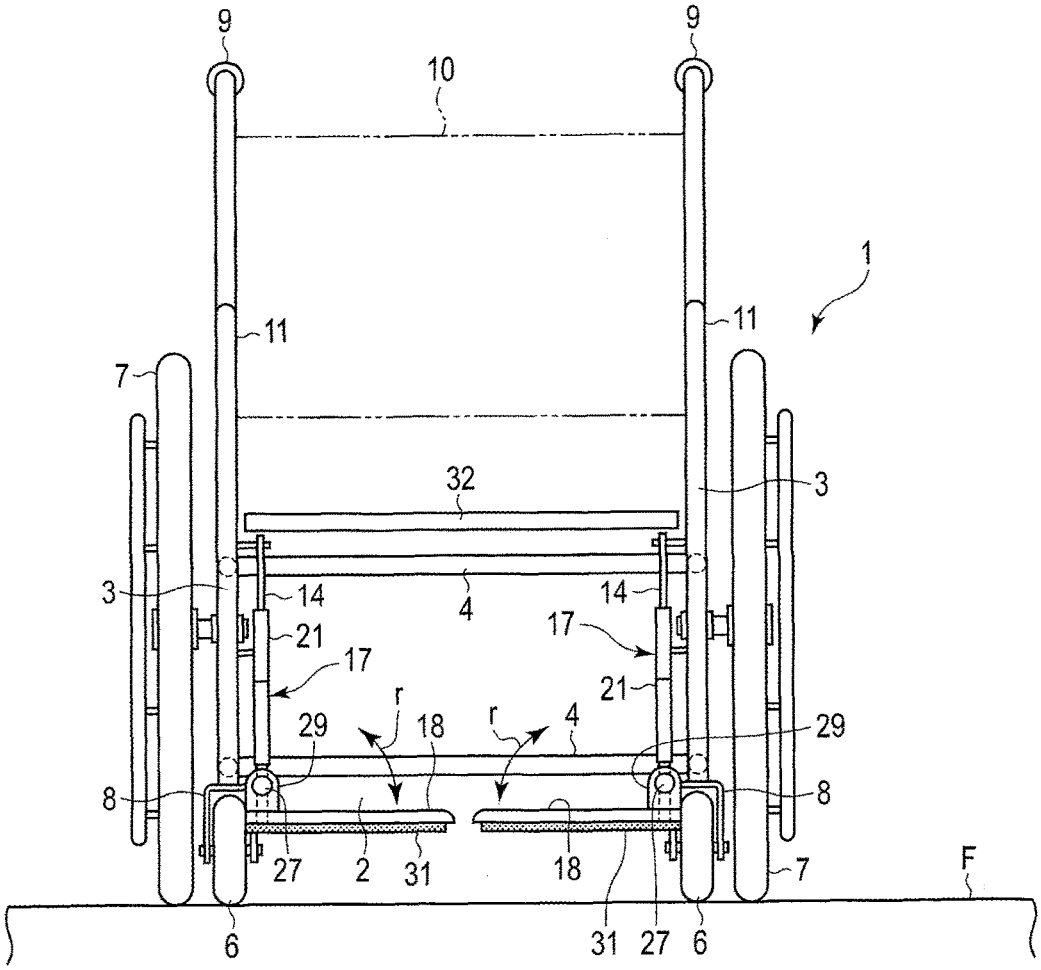
FIG. 1 is a front view of a wheelchair according to a first embodiment of the present invention.
Figure 2:
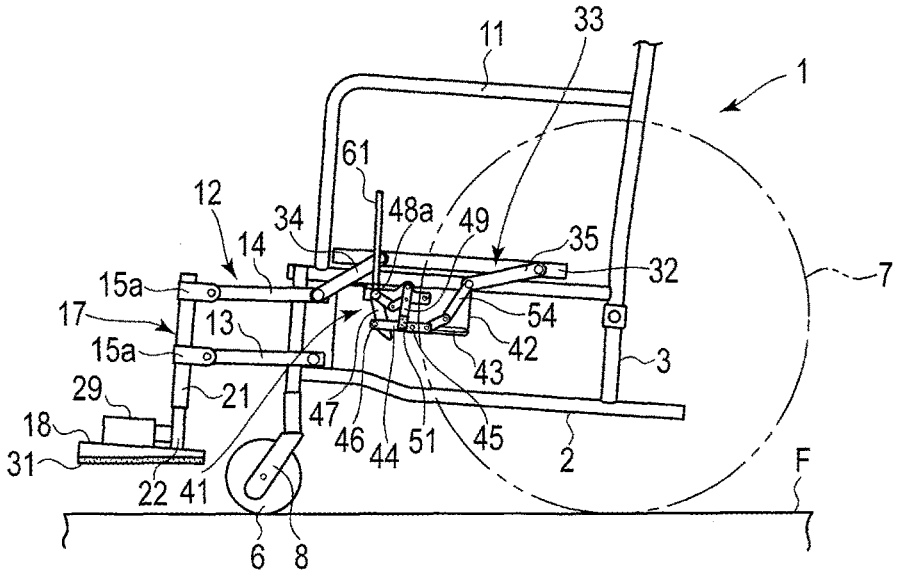
FIG. 2 is a side view of the wheelchair in a state in which brake mechanisms are released while a seat is lowered.

FIG. 1 to FIG. 9 show a first embodiment of the present invention. FIG. 1 is a front view of a wheelchair 1, and FIG. 2 is a side view thereof. The wheelchair 1 comprises a body 2 as a main body. The body 2 is structured by coupling a pair of side frames 3 formed in the shape of a rectangular frame in parallel to keep a predetermined distance therebetween by transverse pipes 4.

It should be noted that the body 2 may has the structure in which the pair of side frames 3 are coupled to be foldable in a width direction by links instead of the transverse pipes 4. That is, the body 2 may be foldable flat in the width direction.

Front wheels 6 are provided at the lower parts of pipes at the front ends of the pair of side frames 3, and rear wheels 7 are provided at intermediate parts of pipes at the back ends. The front wheels 6 and the rear wheels 7 contact a floor F, which is a contact patch.

To the lower ends of the pipes at the front ends of the side frames 3, support arms 8 are attached to be horizontally rotatable. In addition, the front wheels 6 are rotatably attached to the support arms 8. The wheelchair 1 can thereby change the direction of travel by means of the front wheels 6.

The pipes at the backs ends of the pair of side frames 3 extend upward, and their upper ends are bent backward. To the ends of bent portions of the pipes, grips 9 gripped when a helper drives the wheelchair 1 are attached.

Although not shown in the figures, brake levers are provided near the grips 9. If the helper grips the brake levers when operating the wheelchair 1, the rear wheels 7 can be braked.

A canvas 10 which is a cloth constituting the back as indicated by a chain line in FIG. 1, for example, is stretched between a pair of pipes extending upward at the back ends of the pair of side frames 3 to be attachable and detachable. A cushion body may be provided instead of the canvas 10.

The top surfaces of both the ends in the width direction of the body 2, that is, the upper ends of the pair of side frames 3, are provided with armrests 11 whose side shape is an L-shape, respectively. To be specific, ends of the armrests 11 are coupled to the upper ends of the pipes at the front ends of the side frames 3, and the other ends are coupled to intermediate parts of portions extending upward of the pipes at the back ends of the side frames 3.

The pipes at the front ends of the side frames 3 and the armrests 11 may be integrally formed of the same pipes.

As shown in FIG. 2, a first link mechanism 12, which is a leg link mechanism, is provided on each front end side of the pair of side frames 3, that is, the front side of the body 2. The first link mechanism 12 comprises a first link 13, one end of which is pivotally attached to an intermediate part in the height direction of the front ends of the side frames 3, and a second link 14 having the same length as the first link 13, one end of which is pivotally attached above the first link 13.

The other ends of the first link 13 and the second link 14 are pivotally attached to a pair of coupling members 15*a* attached to a fixed cylinder 21 of a height adjustment mechanism 17, which will be described later, to keep the same distance therebetween as that between the one end of the first link 13 and the one end of the second link 14. That is, the first link 13 and the second link 14 are coupled in parallel or substantially in parallel.

Figure 4:
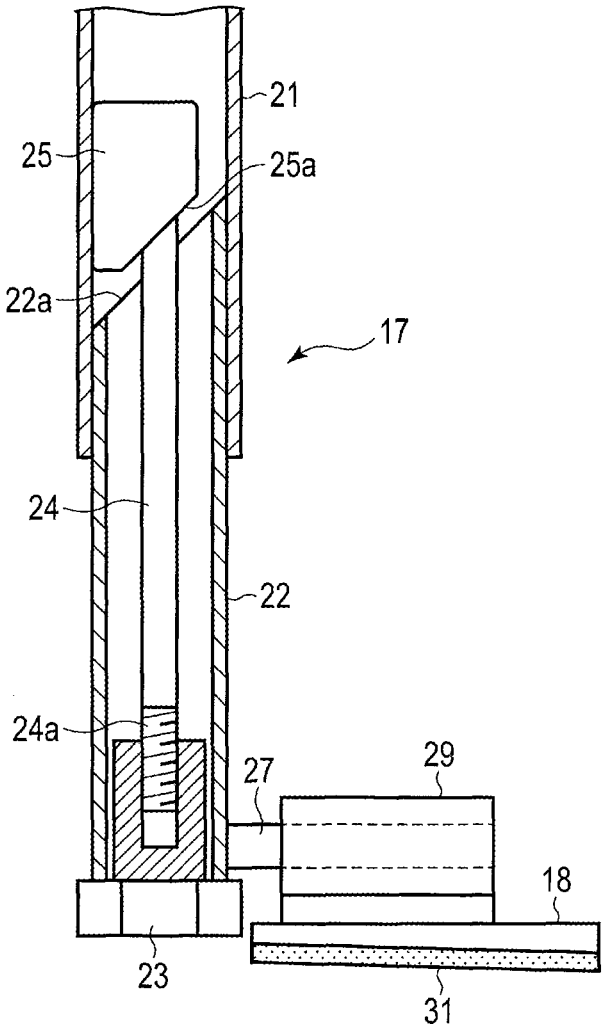
FIG. 4 is a cross-sectional view of a height adjustment mechanism for adjusting a height position of a footrest.

As shown in FIG. 1, at each pair of first and second links 13 and 14, provided right and left, a footrest 18 is horizontally provided via the height adjustment mechanism 17, as will be described later. The height adjustment mechanism 17 comprises the fixed cylinder 21 coupled and fixed to the first and second links 13 and 14 as shown in FIG. 4. The lower end of the fixed cylinder 21 is open, and in the fixed cylinder 21, a movable cylinder 22 projecting from the lower end is inserted to be slidable. The movable cylinder 22 is inserted a height adjustment shaft 24 which comprises a male screw portion 24*a* at a lower end onto which a locknut 23 is screwed.

To the tip of the height adjustment shaft 24, a pressure member 25 whose bottom surface is formed as an inclined surface 25*a* is eccentrically coupled. The upper end of the movable cylinder 22 is formed as an inclined surface 22*a* at an angle corresponding to that of the inclined surface 25*a* of the pressure member 25.

When the locknut 23 is screwed and the height adjustment shaft 24 is slid downward, the inclined surface 25*a* of the pressure member 25 slides while being pressed against the inclined surface 22*a* of the movable cylinder 22, and a part of outer peripheral surface of the pressure member 25 is pressed against the inner peripheral surface of the fixed cylinder 21. The movable cylinder 22 is thereby held to be unable to slide on the fixed cylinder 21.

By sliding the movable cylinder 22 on the fixed cylinder 21 for a predetermined projection length with the locknut 23 loosened, and screwing the locknut 23 at that position, the movable cylinder 22 can be fixed to project for a predetermined length from the lower end of the fixed cylinder 21. That is, the height adjustment mechanism 17 has a function to set the vertical length dimension which is configured with the fixed cylinder 21 and the movable cylinder 22.

To the outer peripheral surfaces of the pair of movable cylinders 22, which project from the lower ends of the fixed cylinders 21, support shafts 27 are attached horizontally and forward in the back-and-forth direction of the body 2. Receivers 29, which are provided at end portions of the footrests 18 in the width direction, are rotatably attached to the support shafts 27. The footrests 18 are thereby attached to rotate in the width direction of the body 2 as indicated by arrows r in FIG. 1.

That is, the footrests 18 can rotate between a horizontal state in which they are fallen inward in the width direction of the body 2 as shown in FIG. 1, and a state in which they stand substantially vertical by being rotated outward in the width direction, and can be held in each of the states.

On the bottom surfaces of the pair of footrests 18, non-slip members 31 formed as plates of materials having a high coefficient of friction such as rubber or resin as non-slip means are stuck. If the user weights his or her feet placed on the footrests 18 when standing up as will be described later, the first link mechanism 12 is worked by the weight, and the pair of footrests 18 are lowered as shown in FIG. 5.

The non-slip members 31 provided on the bottom surfaces of the lowered footrests 18 are pressed against the floor F. That is, the footrests 18 are vertically lowered in a horizontal state, and thus, the whole bottom surfaces where the non-slip members 31 are provided contact the floor F.

The wheelchair 1 is thereby prevented from slipping on the floor F when the user stands with the footrests 18 lowered. That is, when the user stands up from the wheelchair 1, the user's pose can be prevented from becoming unstable because of a slip of the wheelchair 1.

Figure 5:
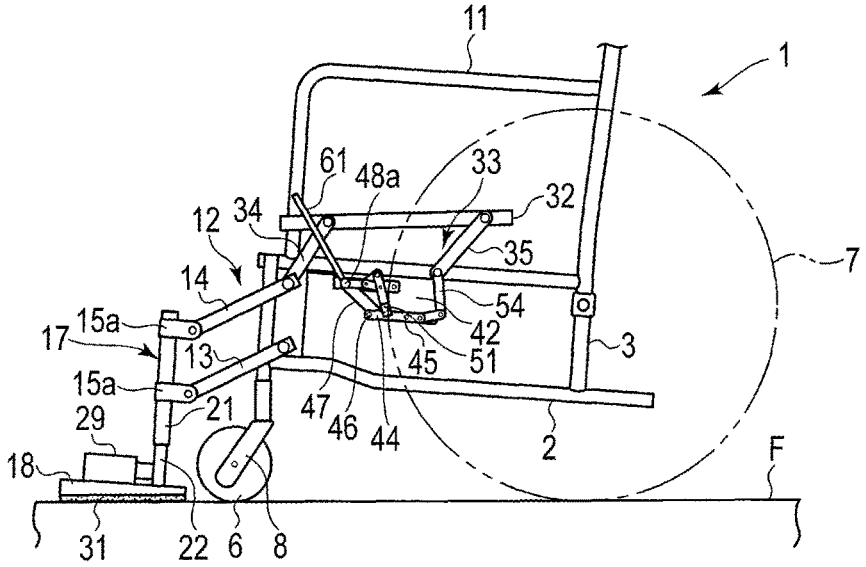
FIG. 5 is a side view of the wheelchair in a state in which the brake mechanisms work while the seat is raised.

As shown in FIG. 5, the height adjustment mechanism 17 is slantingly attached to the second links 14 and 15, such that its lower end is located a little more forward than when it is vertical. Therefore, the bottom surfaces of the footrests 18 are formed as inclined surfaces 18*a*, such that the whole bottom surfaces of the non-slip members 31 contact the floor F when the footrests 18 are lowered.

As the non-slip means, instead of sticking plate materials such as rubber or resin on the bottom surfaces of the footrests 18, the bottom surfaces of the footrests 18 may be formed into a shape having a high coefficient of friction, for example, rough surfaces.

Figure 3:
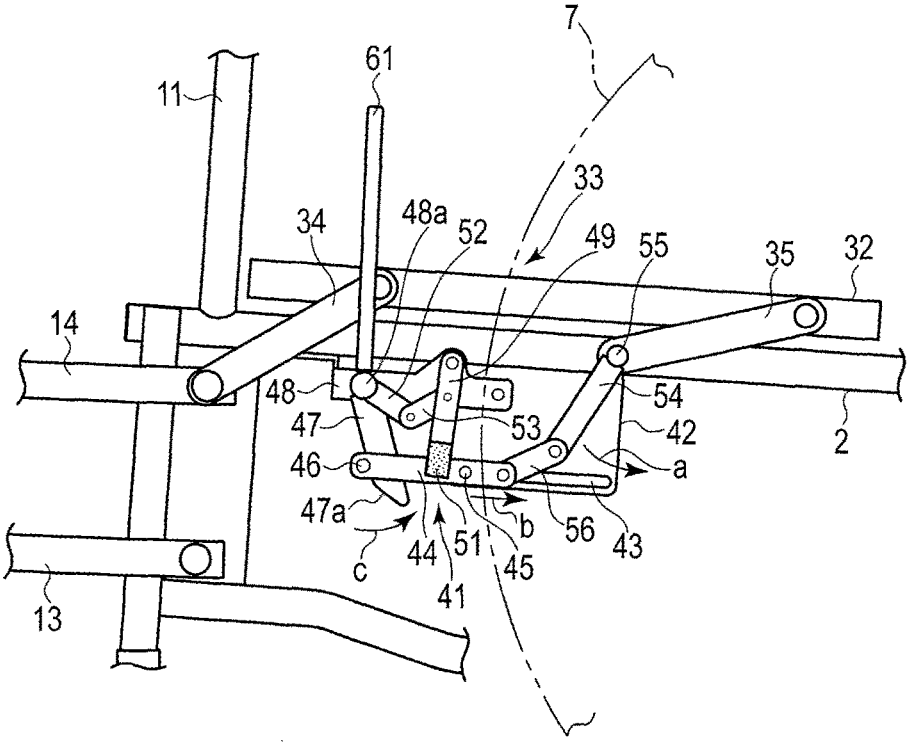
FIG. 3 is an enlarged view of the brake mechanisms of the wheelchair in the state shown in FIG. 2.

As shown in FIG. 2 and FIG. 3, on the top surface side of the body 2, a rectangular seat 32 is provided to be movable up and down by means of a second link mechanism 33 as a seat link mechanism. The second link mechanism 33 comprises a fourth link 34, one end of which is pivotally attached to the same portion as one end of the second link 14 of the first link mechanism 12. The fourth link 34 rotates integrally with the second link 14.

The second link 14 and the fourth link 34 may not be separate but integrally formed in a state in which the fourth link 34 is bent from one end of the second link 14 at a predetermined angle, such that a boundary therebetween is pivotally attached to the pipes at the front ends of the side frames 3.

The other end of the fourth link 34 extends toward the back of the body 2, and is pivotally attached to a portion on the front end side of the seat 32, namely a side portion at the front end in the present embodiment. To a side portion on the back end side of the seat 32, one end of a fifth link 35, the other end of which is pivotally attached to a higher position than one end of the fourth link 34 closer to the back end side than the fourth link 34 on the top surface of the body 2, is pivotally attached. The fifth link 35 is set in the same length as the fourth link 34.

Figure 7:
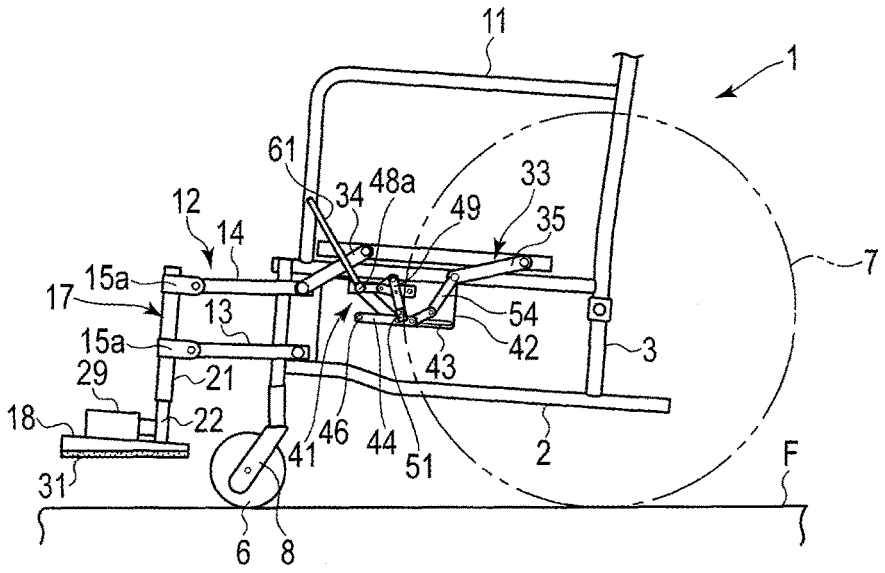
FIG. 7 is a side view of the wheelchair in a state in which the brake mechanisms work while the seat is lowered.

The fourth link 34 and the fifth link 35 rotate in the same direction. Thus, in accordance with the direction of the rotation, the seat 32 is driven in a direction in which it is raised from the top surface of the body 2 while being inclined to become lower toward the front as shown in FIG. 5, or in a direction in which it is lowered to be horizontal as shown in FIG. 7 from a raised state.

The first link mechanism 12 and the second link mechanism 33 can be worked by applying external force.

In the present embodiment, the weights of the seat 32 and the footrests 18 are set, such that in a state in which no load (i.e., external force) is added to the footrests 18 and the seat 32, the seat 32 is lowered to the lower limit by the second link mechanism 33 as shown in FIG. 2, and the footrests 18 are lifted to the upper limit by the first link mechanism 12.

Therefore, by adding a load to the footrests 18 in the state shown in FIG. 2, the footrests 18 can be displaced downward as shown in FIG. 5.

Either of the fourth and fifth links 34 and 35 of the second link mechanism 33 may be urged by an urging means such as a gas spring or a spring in a direction in which the seat 32 is raised, which is a direction in which the fourth and fifth links 34 and 35 stand up.

By doing so, when the user sits in the seat 32, the seat 32 is lowered against urging force of the urging means, and the footrests 18 are lifted. In addition, when the user stands, the seat 32 pushes the user's buttocks upward by urging force of the urging means. Thus, the user is assisted in standing.

The rear wheels 7 can be prevented from rotating, that is, can be braked by brake mechanisms 41. The brake mechanisms 41 each comprise a base member 42 in the shape of a flat plate drooping along the back-and-forth direction on one side at the upper part on the front end side of the body 2 as shown in FIG. 3. At the lower end of the base material 42, a guide long hole 43 is formed along the back-and-forth direction.

In the guide long hole 43, a slide link 44 is provided by engaging a guide pin 45 provided at its intermediate part in the longitudinal direction, such that it is slidable. Although not shown in the figures, the guide pin 45 comprises a head having a greater diameter than the width of the guide long hole 43. The guide pin 45 is thereby prevented from coming out of the guide long hole 43.

At one end of the slide link 44, an engagement pin 46 is provided. With the engagement pin 46, a tip portion of a rotation link 47 engages. The tip portion (the other end) of the rotation link 47 is formed as a tapered surface 47*a* having a tapered shape.

On the front end side of the base material 42, an attachment member 48 is provided. To the attachment member 48, a proximal end (one end) of the rotation link 47 is pivotally attached by a support shaft 48*a*. That is, the rotation link 47 and the support shaft 48*a* are integrated, and the support shaft 48*a* is rotatably attached to the attachment member 48.

To an intermediate part of the attachment member 48, a proximal end (one end) of a brake link 49 is rotatably attached. A tip portion of the brake link 49 faces the outer peripheral surfaces of the rear wheels 7, and at its tip (the other end), a brake member 51 is provided.

To the support shaft 48*a*, to which the base end of the rotation link 47 is pivotally attached, one end of a first interlock link 52 is coupled integrally, that is, such that it rotates together with the support shaft 48*a*. To an intermediate part of the brake link 49, one end of a second interlock link 53 is pivotally attached. The other end of the first interlock link 52 and the other end of the second interlock link 53 are pivotally attached to each other.

Figure 6:
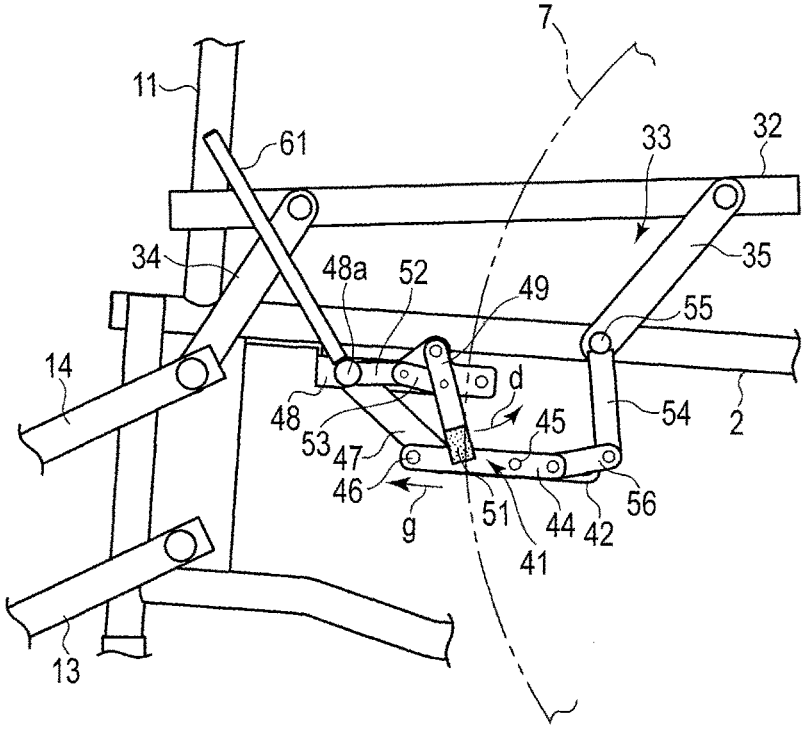
FIG. 6 is an enlarged view of the brake mechanisms of the wheelchair in the state shown in FIG. 5.

The first interlock link 52 and the second interlock link 53 bend in a V-shape as shown in FIG. 3 when the seat 32 is located at a lowered position, and are substantially straight as shown in FIG. 6 when the seat 32 is located at a raised position.

As described above, one end of the fourth link 34, which couples the seat 32 to the body 2, is pivotally attached to a lower position of the body 2 than one end of the fifth link 35.

Thus, the fourth link 34 and the fifth link 35 are not in a parallel state. Thus, when the seat 32 is raised as shown in FIG. 5 and FIG. 6, the seat 32 is inclined to become lower toward the front.

In addition, the fourth link 34 and the fifth link 35 may be formed in parallel, such that the seat 32 is raised in a horizontal state. To be specific, both the ends of the fourth link 34 and the fifth link 35 of the same length may be pivotally attached to the same height positions of the body 2 and the seat 32, respectively, such that they are parallel to each other.

By doing so, the seat 32 can move up and down in a horizontal state when the fourth link 34 and the fifth link 35 are rotated.

To an end portion of the fifth link 35, which is pivotally attached to the body 2 by a support shaft 55, one end of a first transmission link 54 is coupled, such that it rotates on the same fulcrum as that of the fifth link 35, and further, integrally with the support shaft 55.

To the other end of the first transmission link 54, one end of a second transmission link 56 is pivotally attached. The other end of the second transmission link 56 is pivotally attached to the other end of the slide link 44. The first transmission link 54 and the second transmission link 56 thereby constitute a transmission means which transmits the movement (rotational movement) of the fifth link 35 made when the seat 32 is raised and lowered to the slide link 44.

To the support shaft 48*a*, by which the base end of the rotation link 47 and one end of the first interlock link 52 are pivotally attached to the attachment member 48, a base end of an operation lever 61 is coupled to rotate integrally with the rotation link 47.

The operation lever 61 can be thereby rotated between a state in which it stands substantially vertical as shown in FIG. 2 and FIG. 3 and a state in which it is inclined toward the front of the body 2 as shown in FIG. 5 and FIG. 6.

As shown in FIG. 2, in a state in which the footrests 18 are lifted up, the seat 32 is located at the lowered position, and the operation lever 61 stands substantially vertical, the first interlock link 52 and the second interlock link 53 bend in a V-shape as shown enlargedly in FIG. 3. In this state, the brake link 49 is rotated, such that the brake member 51 provided at its tip portion is separated from the outer peripheral surfaces of the rear wheels 7.

As shown in FIG. 2, when the user sitting in the seat 32 stands with his or her feet placed on the footrests 18 in a state in which the footrests 18 are lifted up, the first link mechanism 12 is worked by the weight of the user and the footrests 18 are lowered.

When the first link mechanism 12 works, the second link mechanism 33 moves in interlock with the working. To be specific, the fourth link 34 in a inclined state as shown in FIG. 3 rotates in a rising direction as shown in FIG. 6 in interlock with the rotating motion of the second link 14 of the first link mechanism 12, and the fifth link 35 moves in interlock with the rotating motion of the fourth link 34 via the seat 32. The seat 32 is thereby raised while being inclined to become lower toward the front as shown in FIG. 5 and FIG. 6.

When the seat 32 is raised and the fifth link 35 rotates in a direction in which the fifth link 35 stand up, the first transmission link 54 moves in interlock with the rotating motion. To be specific, the first transmission link 54 rotates counterclockwise as indicated by arrow a in FIG. 3 integrally with the fifth link 35 with the support shaft 55 functioning as a fulcrum.

When the first transmission link 54 rotates, the second transmission link 56, one end of which is coupled to the first transmission link 54, moves in the rotation direction of the first transmission link 54, that is, a direction indicated by arrow b in FIG. 3. The slide link 44 coupled to the second transmission link 56 moves in interlock with the movement.

To be specific, the slide link 44 slides toward the back of the body 2 while the guide pin 45 provided at its intermediate part is guided by the guide long hole 43. FIG. 6 shows a state in which the slide link 44 has slid.

When the slide link 44 slides, the rotation link 47 rotates counterclockwise as indicated by arrow c in FIG. 3 together with the support shaft 48*a* with the support shaft 48*a* functioning as a fulcrum because of the engagement between the engagement pin 46 provided at one end of the slide link 44 and the tip portion of the rotation link 47.

The first interlock link 52 and the second interlock link 53, which have been bent in a V-shape as shown in FIG. 3, thereby become substantially straight with the support shaft 48*a* as a starting point as shown in FIG. 6. As a result, the brake link 49, an intermediate part of which is pivotally attached to one end of the second interlock link 53, rotates counterclockwise with its proximal end pivotally attached to the attachment member 48 functioning as a fulcrum as indicated by arrow d in FIG. 6.

As shown in FIG. 6, when the brake link 49 rotates counterclockwise, the brake member 51 provided at its tip is pressed against the outer peripheral surfaces of the rear wheels 7, and thus, the rear wheels 7 are held immovable. To be specific, when the user places his or her feet on the footrests 18 and stands while lowering the footrests 18, the brakes of the brake mechanisms 41 are automatically applied, and thus, the body 2 is prevented from moving when the user stands.

Moreover, when the footrests 18 are trodden until they contact the floor F, the non-slip members 31 provided on the bottom surfaces of the footrests 18 are pressed against the floor F. To be specific, the bottom surfaces of the footrests 18, which are vertically lowered in a horizontal state, contact the floor F uniformly and surely.

Therefore, even if the body 2 is likely to move because of the front wheels 6 and the rear wheels 7 provided in the body 2, the movement of the body 2 is limited by the non-slip members 31 pressed against the floor F when the user stands up. Also for this reason, the user can stand in stable condition.

Figure 8:
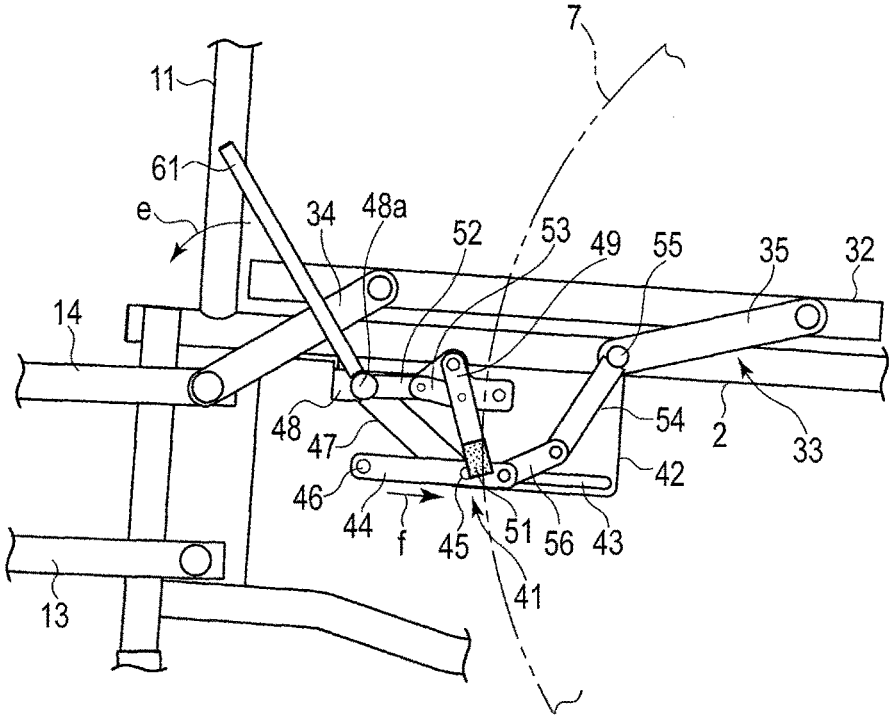
FIG. 8 is an enlarged view of the brake mechanisms of the wheelchair in the state shown in FIG. 7.

On the other hand, if the operation lever 61, which stands substantially vertical, is rotated toward the front of the body 2 as indicated by arrow e in FIG. 8, that is, counterclockwise, in a state in which the seat 32 is lowered as shown in FIG. 2 and FIG. 3, the first interlock link 52 and the second interlock link 53, which are bent substantially in a V-shape as shown in FIG. 3, rotate and become substantially straight.

The brake link 49 is thereby pressed by the second interlock link 53, and rotates. Thus, the brake member 51 provided at the tip of the brake link 49 is pressed against the outer peripheral surfaces of the rear wheels 7, and the brakes are applied.

To be specific, even if the user remains sitting in the seat 32, the brakes can be applied by working the brake mechanisms 41 to prevent the wheelchair 1 from moving.

In order for the user sitting in the seat 32 to release the brakes applied on the rear wheels 7 in a state in which the user brakes while sitting in the seat 32, the operation lever 61 is rotated clockwise in a direction opposite to that indicated by arrow e in FIG. 8.

The first interlock link 52 and the second interlock link 53, which have been substantially straight, are thereby bent in a V-shape, and thus, the brakes applied by the brake link 49 can be released.

In addition, when the user sitting in the seat 32 stands while lowering the footrests 18 in a state in which the rear wheels 7 are braked as shown in FIG. 7 and FIG. 8, the second link mechanism 33 works, and the seat 32 is raised.

The first link mechanism 12 and the second link mechanism 33 thereby work, and the slide link 44 slides in a direction indicated by arrow f in FIG. 8.

However, the rotation link 47 is rotated in advance counterclockwise, and the engagement pin 46 provided at one end of the slide link 44 and the tip portion of the rotation link 47 are separated.

Thus, even if the slide link 44 slides along the guide long hole 43, the brake link 49 does not rotate. That is, the brakes applied by the brake member 51 are maintained.

In a state in which the seat 32 is raised and the rear wheels 7 are braked as shown in FIG. 5 and FIG. 6, when the user sits and lowers the seat 32, the slide link 44 slides in a direction indicated by arrow g in FIG. 6.

However, at that time, the engagement pin 46 provided at the tip portion of the slide link 44 does not press the rotation link 47, the rotation link 47 is not rotated by the sliding motion of the slide link 44.

Therefore, even if the user sits in the raised seat 32 and lowers the seat 32 in a state in which the rear wheels 7 are braked, the brakes on the rear wheels 7 are not automatically released.

To release the brakes on the rear wheels 7 in a state in which the seat 32 is lowered, the operation lever 61, which is inclined toward the front of the body 2, is rotated clockwise in a direction opposite to that indicated by arrow e in FIG. 8, that is, in a rising direction.

The first interlock link 52 and the second interlock link 53, which have been straight, are thereby bent in a V-shape as shown in FIG. 3, and the brake link 49 can be rotated in a direction in which the brake member 51 at its tip is separated from the rear wheels 7. Thus, the brakes on the rear wheels 7 are released.

In this manner, according to the wheelchair 1 having the above-described structure, when the user places his or her feet on the footrests 18 and stands up while lowering the footrests 18, the seat 32 is raised in interlock with the lowering motion of the footrests 18.

When the seat 32 is raised, the brake mechanisms 14 work in interlock with the raising motion, and turning of the rear wheels 7 of the wheelchair 1 is prevented. That is, when the user stands up from the wheelchair 1, the rear wheels 7 are automatically braked.

Therefore, even if the user adds accidental external force to the wheelchair 1 by, for example, concentrating force on the hands with which the user grasps the armrests 11 of the wheelchair 1 to keep a balance himself or herself after standing up from the wheelchair 1 while grasping the armrests 11, the wheelchair 1 does not move, and thus, the user can maintain standing posture with stability.

The brake mechanisms 41 can be worked by operating the operation lever 61, even when the user is sitting in the seat 32. Thus, for example, if the user rests, sitting in the seat 32, the wheelchair 1 can be prevented from accidentally moving by operating the operation lever 61 and braking the wheelchair 1.

Even if the user sits and lowers the seat 32 in a state in which the seat 32 is raised and the rear wheels 7 are braked as shown in FIG. 5 and FIG. 6, the brakes on the rear wheels 7 are not released.

To release the brakes on the rear wheels 7 in a state in which the user sits, the operation lever 61, which is inclined toward the front of the body 2 as shown in FIG. 8, is manually rotated into a substantially vertical state as shown in FIG. 3.

The brake link 49 is thereby rotated, and the brakes on the rear wheels 7 can be released. That is, even if the user sits in the seat 32, the wheelchair 1 does not accidentally move unless the operation lever 61 is operated.

A height at which the seat 32 is raised can be changed by adjusting a length for which the movable cylinders 22 of the height adjustment mechanisms 17 project from the fixed cylinders 21. When the height at which the seat 32 is raised is increased, a sliding distance of the slide link 44 increases.

Figure 9:
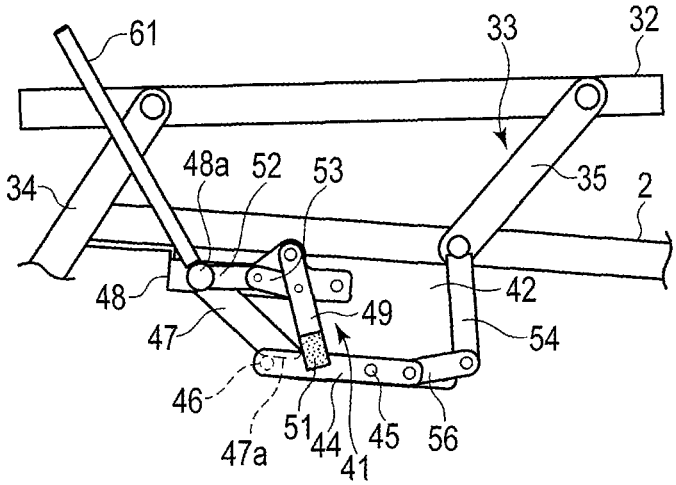
FIG. 9 is an enlarged view of the brake mechanisms showing a state in which an engagement pin provided in a slide link has slid along a tapered surface of a rotation link.

As shown in FIG. 9, even if the sliding distance of the slide link 44 increases, the lower end of the rotation link 47 is formed as the tapered surface 47*a*. Thus, even if the sliding distance of the slide link 44 increases, the engagement pin 46 provided in the slide link 44 slides along the tapered surface 47*a*, and thus, the raising motion of the seat 32 is not inhibited. That is, the elevation height of the seat 32 can be increased in accordance with the length of the tapered surface 47*a*.

(Second Embodiment)

Figure 10:
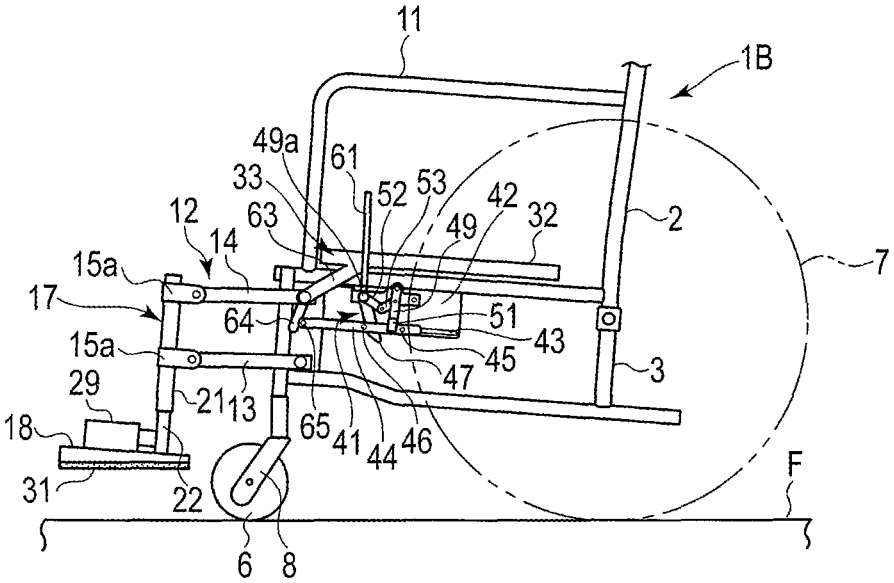
FIG. 10 is a side view of a wheelchair in a state in which a seat is lowered and brakes are released according to a second embodiment of the present invention.
Figure 11:
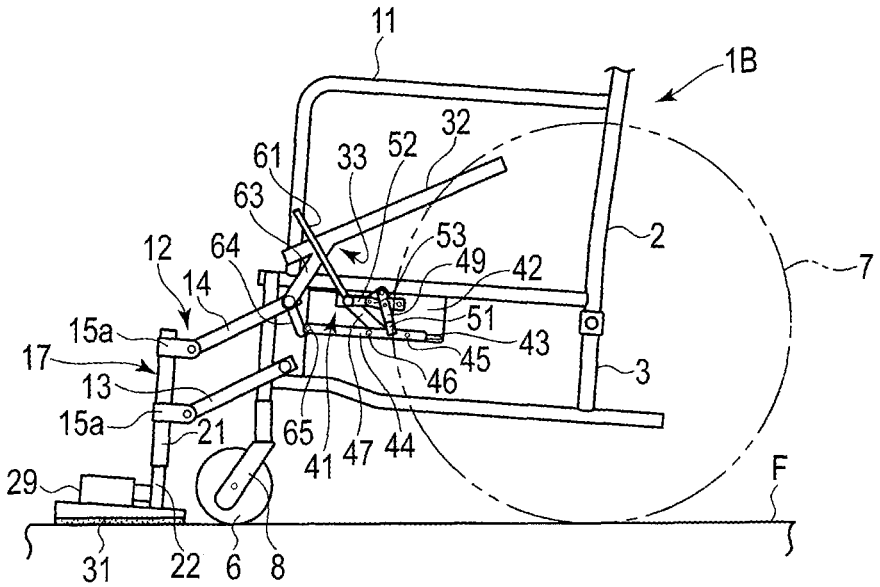
FIG. 11 is a side view of the wheelchair in a state in which the brakes work while the seat is raised.

FIG. 10 and FIG. 11 show a wheelchair 1B according to a second embodiment of the present invention. The present embodiment is a modification of the second link mechanism 33 of the first embodiment. The same portions as those of the first embodiment are given the same symbols, and explanations thereof are omitted.

The second link mechanism 33 of the present embodiment is composed of one interlock link 63, one end of which is coupled and fixed to the bottom surface on the front end side of the seat 32 at a predetermined angle of inclination. The other end of the interlock link 63 is integrally attached to one end of the second link 14 of the first link mechanism 12, which is pivotally attached to the upper part on the front end side of the body 2. That is, the interlock link 63 rotates integrally with the second link 14.

In the present embodiment, the interlock link 63 is formed separately from the second link 14; however, they may be integrated, that is, may be continuously and integrally formed in a state in which the second link 14 and the interlock link 63 are bent, such that a boundary at which they are bent is pivotally attached to a front end portion of the side frame 3.

At a portion where the second link 14 and the interlock link 63 are pivotally attached to each other, a pressing arm 64, one end of which is coupled thereto, is provided to rotate integrally with the interlock link 63. The other end of the pressing arm 64 engages with an interlock pin 65 provided at the tip of the slide link 44.

In the second embodiment, the slide link 44 is formed longer than the slide link 44 of the first embodiment so that the other end of the pressing arm 64 engages with the interlock pin 65.

As in the first embodiment, in the slide link 44 of the second embodiment, the engagement pin 46, which engages with a tip portion of the rotation link 47, is provided closer to the back end side than the interlock pin 65, and the guide pin 45, which engages with the guide long hole 43 formed in the base material 42, is provided closer to the back end side than the engagement pin 46.

According to the wheelchair 1B having the above-described structure, in a state in which the seat 32 is sunk and the footrests 18 are raised as shown in FIG. 10, if the user sits in the seat 32 and stands with his or her feet placed on the footrests 18, the footrests 18 falls, and the seat 32 moves in interlock with the falling motion.

The seat 32 thereby rotates in a direction in which its back is raised with the front end side functioning as a fulcrum as shown in FIG. 11. That is, the seat 32 is rotated and raised slantingly.

When the seat 32 is rotated and raised, the pressing arm 64 rotates the one end of which in the backward direction with the other end functioning as a fulcrum, and the tip portion, which is the one end of the pressing arm 64, presses the interlock pin 65 provided at the tip portion of the slide link 44.

Because the slide link 44 is thereby slid backward as shown in FIG. 11, the rotation link 47 is rotated by the engagement pin 46 provided at an intermediate part of the slide link 44.

When the rotation link 47 rotates, the first interlock link 52 and the second interlock link 53, which have been bent in a V-shape, become substantially straight, and the brake link 49 rotates. When the brake link 49 rotates, the brake member 51 provided at the tip portion of the brake link 49 is pressed against the rear wheels 7.

That is, when the user stands up from the seat 32 while lowering the footrests 18, the rear wheels 7 are automatically braked.

When the user sits in the seat 32, which is rotated and raised as shown in FIG. 11, the seat 32 rotates in a flattened direction together with the interlock link 63 constituting the second link mechanism 33. At that time, the second link mechanism 33 moves in interlock with the rotating motion of the seat 32, and the footrests 18 are lifted up.

However, because the brake link 49 does not move in interlock with the raising motion of the seat 32 and the lifting motion of the footrests 18, the rear wheels 7 remain in a braked state. That is, the brakes on the rear wheels 7 are not released simply by the user's sitting in the wheelchair 1B, which is braked. Therefore, even if the user sits in the wheelchair 1B, the wheelchair 1B does not move accidentally.

In order for the user sitting in the seat 32 to release the brakes on the rear wheels 7, the operation lever 61, which is inclined forward as shown in FIG. 11, is rotated backward until it becomes substantially vertical as shown in FIG. 10.

The brake link 49 can be thereby rotated in a direction in which the brake member 51 is separated from the rear wheels 7, and thus, the brakes on the rear wheels 7 can be released.

At this time, because the rotation link 47 rotates together with the operation lever 61, the slide link 44 slides toward the front of the body 2, and the tip of the slide link 44 contacts the tip of the pressing arm 64. That is, the state shown in FIG. 10 appears again.

In this manner, also in the wheelchair 1B of the second embodiment, as in the first embodiment, when the user sits in the seat 32 in a raised state and lowers the seat 32, the rear wheels 7 remains braked, and the operation lever 61 must be operated to release the brakes.

Therefore, the wheelchair 1B can be prevented from accidentally moving by the user's sitting therein. Moreover, when the user stands up from the seat 32 after lowering the footrests 18 and raising the seat 32, the rear wheels 7 are automatically braked. Therefore, even if the user stands up while grasping the body 2, the body 2 does not accidentally move.

(Third Embodiment)

Figure 12:
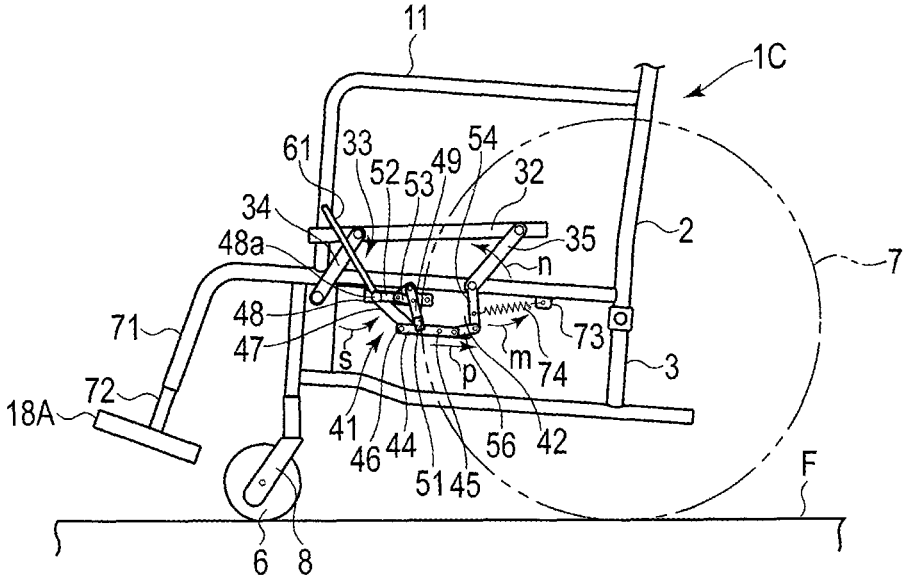
FIG. 12 is a side view of a wheelchair in a state in which brakes are applied while a seat is raised according to a third embodiment of the present invention.
Figure 13:
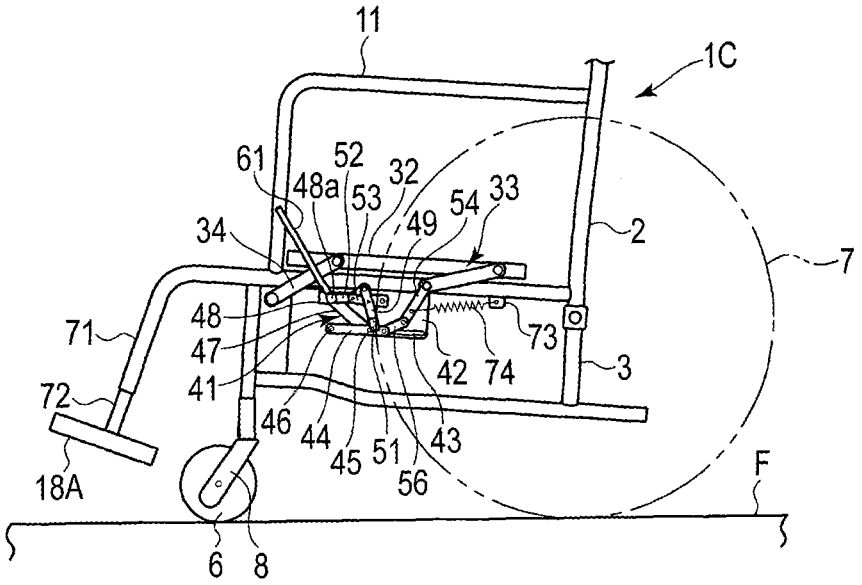
FIG. 13 is a side view of the wheelchair in a state in which the brakes are applied while the seat is lowered.
Figure 14:
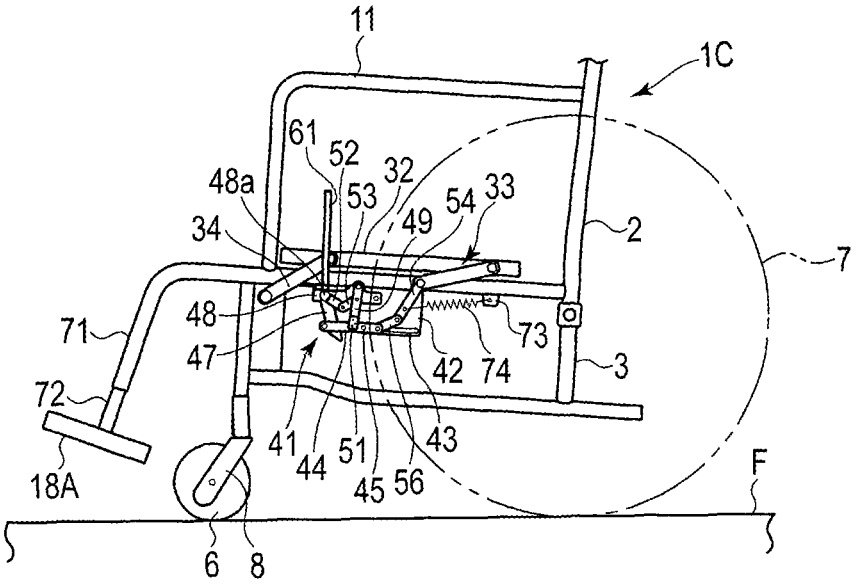
FIG. 14 is a side view of the wheelchair in a state in which the brakes are compulsorily released when the seat is lowered.

FIG. 12 to FIG. 14 show a third embodiment of the present invention. A wheelchair 1C of the third embodiment is a modification of the wheelchair 1 of the first embodiment. In the third embodiment, the same portions as those of the first embodiment are given the same symbols, and explanations thereof are omitted.

In the first embodiment, the footrests 18 are provided on the front end side of the body 2 to be movable up and down. However, in the third embodiment, footrests 18A are provided on the front end side of the body 2 to be not movable up and down, but are fixedly provided on the body 2.

To be specific, at the front ends of the pair of side frames 3 of the body 2, a pair of support members 71 (only one of which is shown in the figures) formed by bending pipe materials in a reverse L-shape is provided to project forward. In addition, the footrests 18A are attached to the lower ends of the support members 71.

On the top surfaces of the footrests 18A, coupling pipes 72 are provided, and the coupling pipes 72 are inserted and fixed in the lower ends of the support members 71. A height at which the footrests 18A are attached can be changed by adjusting a length for which the coupling pipes 72 are inserted in the support members 71.

As in the first embodiment, the footrests 18A are used in a state in which they are flattened horizontal to the width direction of the body 2, and when not used, they are rotated outward in the width direction of the body 2, and can be held in a state in which they stand substantially vertical.

The seat 32 on the top surface side of the body 2 is provided to be movable up and down by means of the second link mechanism 33 as a seat link mechanism having the same structure as in the first embodiment. To be specific, the seat 32 can move up and down by means of the second link mechanism 33 between a raising state in which it is inclined to become lower toward the front as shown in FIG. 12 and a lowering state in which it is a horizontal state as shown in FIG. 13.

An attachment piece 73 is provided at a portion on the bottom surface side of the seat 32 on the back end side of the side frames 3, and a spring 74 as an urging means is stretched between the attachment piece 73 and the first transmission link 54 of the second link mechanism 33. The first transmission link 54 is elastically urged by the spring 74 counterclockwise as indicated by arrow m in FIG. 12.

The urging means is not limited to the spring 74, and may be, for example, a gas spring. In short, it may be anything that can elastically urge the second link mechanism 33 in a direction in which the seat 32 is raised.

When the first transmission link 54 is urged by the spring 74 in the direction indicated by arrow m, the first transmission link 54 is rotated by the urging force counterclockwise as indicated by arrow m with one end integrally coupled to the fifth link 35 functioning as a fulcrum as shown in FIG. 12. Thus, the fifth link 35 rotates and uprights counterclockwise as indicated by arrow n in the figure, that is, an upward direction, in interlock with the rotating motion.

When the fifth links 35 rotates and rises, the seat 32 moves in interlock with the movement, and the fourth link 34 rotates and rises in interlock with the movement of the seat 32.

The seat 32 is thereby raised and held, elastically in a raised state in which it is inclined to become lower toward the front by the urging force of the spring 74 as shown in FIG. 12, that is, in the raised state in which the seat 32 can be lowered against the urging force of the spring 74.

To be specific, in a state in which no external force such as the weight of the user is added to the seat 32, the seat 32 is elastically held at a position where it is raised by the urging force of the spring 74.

When the first transmission link 54 is rotated by the spring 74 in the direction indicated by arrow m, the first transmission link 54 slides the slide link 44 from the state shown in FIG. 13 in a direction indicated by arrow p in FIG. 12 via the second transmission link 56.

The rotation link 47 is thereby rotated by the engagement pin 46 provided in the slide link 44 counterclockwise as indicated by arrow s in FIG. 12. When the rotation link 47 rotates in the direction indicated by arrow s, the first interlock link 52 rotates in interlock with the rotation. Thus, the first interlock link 52 and the second interlock link 53, which have been bent in a V-shape as shown in FIG. 13, become substantially straight as shown in FIG. 12.

The brake link 49, an intermediate part of which is pivotally attached to one end of the second interlock link 53, thereby rotates with its one end functioning as a fulcrum, and the brake member 51 provided at its tip portion, which is the other end, is pressed against the outer peripheral surfaces of the rear wheels 7. That is, the rear wheels 7 are braked.

According to the wheelchair 10 having the above-described structure, when the user does not sit in the seat 32 as shown in FIG. 12, the fourth link 34 and the fifth link 35 of the second link mechanism 33 are rotated in a rising direction by the urging force of the spring 74. The seat 32 is thereby raised in a state in which it is inclined to become lower toward the front.

When the user sits in the seat 32 which is the raised state as shown in FIG. 12, the seat 32 is lowered, while the fourth link 34 and the fifth link 35 of the second link mechanism 33 are rotated in a inclined direction against the urging force of the spring 74 by the weight of the user. FIG. 13 shows a state in which the seat 32 is lowered.

When the seat 32 is lowered, the first transmission link 54 rotates clockwise integrally with the fifth link 35, and thus, the slide link 44 slides in a direction opposite to that indicated by arrow p in FIG. 12.

At this time, the engagement pin 46, which is provided at a tip portion in a sliding direction of the slide link 44, does not engage with the rotation link 47, and thus, the rotation link 47 is not rotated in the sliding direction of the slide link 44. To be specific, the brake member 51 provided at the tip portion of the rotation link 47 is pressed against the outer peripheral surfaces of the rear wheels 7, and a state in which the rear wheels 7 are braked is maintained.

To drive the wheelchair 1C after the user sits in the seat 32, the operation lever 61 inclined toward the front of the body 2 as shown in FIG. 13 is rotated backward in a standing direction as shown in FIG. 14.

The first interlock link 52 and the second interlock link 53, which have been substantially straight as shown in FIG. 13, are thereby bent substantially in a V-shape as shown in FIG. 14, and the brake link 49 is rotated in a direction in which the brake member 51 provided at its tip is separated from the rear wheels 7. That is, the brakes on the rear wheels 7 are released, and thus, the user can drive the wheelchair 1C.

Specifically, according to the wheelchair 10 having the above-described structure, the second link mechanism 33, by which the seat 32 is attached on the top surface side of the body 2 to be movable up and down, is urged by the spring 74, and the seat 32 is elastically held at the raised position by means of the urging force.

Further, when the seat 32 is located at the raised position, the brake member 51 provided at the brake link 49 is pressed against the rear wheels 7 to cause a braked state. Even if the user sits in the seat 32 and lowers the seat 32 in this state, the brakes on the rear wheels 7 are not released.

Thus, when the user sits in the seat 32, the rear wheels 7 are braked, and thus, the wheelchair 10 does not accidentally move. Accordingly, the user can sit in the seat 32 securely.

Even when the user sits in the seat 32, the rear wheels 7 are in a braked state as shown in FIG. 13. In addition, to release the brakes on the rear wheels 7 after sitting in the seat 32, the user must pull the operation lever 61 toward himself or herself, and rotate it in a rising direction as shown in FIG. 14.

That is, the wheelchair 10 does not move unless the user sits in the seat 32 and releases the brakes on the rear wheels 7. Also for this reason, the wheelchair 10 can be surely prevented from accidentally moving.

Moreover, according to the third embodiment, when the user stands up from the seat 32, the second link mechanism 33, which is elastically urged upward by the spring 74, is worked and the rear wheels 7 can be automatically braked, even if the footrests 18 are not configured to move up and down by means of the first link mechanism 12 as in the first embodiment. Accordingly, the structure for braking the rear wheels 7 can also be more simplified than in the first embodiment.

Since the seat 32 is urged upward by the spring 74, the seat pushes the user's buttocks upward by restoring force of the spring 74 when the user sitting in the seat 32 stands up. Therefore, the user can also stand up from the seat with relative ease.

EXPLANATIONS OF LETTERS OR NUMERALS

2 body, 3 side frames, 11 armrests, 12 first link mechanism (leg link mechanism), 13 first link, 14 second link, 15 third link, 17 height adjustment mechanism, 18 footrest, 31 non-slip members, 32 seat, 33 second link mechanism, 34 fourth link, 35 fifth link, 41 brake mechanisms, 44 slid link, 45 guide pin, 46 engagement pin, 47 rotation link, 49 brake link, 51 brake member, 61 operation lever, 74 spring (urging means).

What is claimed is:

1. A wheelchair comprising:

a main body;

a wheel rotatably provided in the main body;

a seat disposed on a top surface side of the main body;

a seat link mechanism by which the seat is supported to be movable up and down between a raised position and a lowered position on the top surface side of the main body;

a brake mechanism which inhibits the wheel from rotating in interlock with the seat link mechanism, when the seat is raised from the lowered position to the raised position;

a footrest provided on a front side of the main body, and a leg link mechanism which drives the footrest in a vertical direction between a lifted-up position and a grounded position, wherein the seat link mechanism is configured to move in interlock with the leg link mechanism to drive the seat from the lowered position to the raised position when the footrest is lowered in a grounded direction.

2. The wheelchair of claim 1, wherein the brake mechanism comprises an operation lever which is manually worked to compulsorily release a brake applied on the wheel in a state in which the brake is applied on the wheel while the seat is lowered.

3. The wheelchair of claim 1, wherein the footrest includes a bottom surface which entirely lands when the footrest is driven in a vertical direction by the leg link mechanism.

4. The wheelchair of claim 1, wherein the leg link mechanism is provided with a height adjustment mechanism configured to adjust a height of the footrest in a vertical direction.

5. The wheelchair of claim 3, wherein the bottom surface of the footrest comprises a non-slip means which contacts a floor when lands.

6. The wheelchair of claim 4, wherein the leg link mechanism comprises:

a first link, one end of which is pivotally attached to the front side of the main body;

a second link, one end of which is pivotally attached to a higher portion than the one end of the first link on the front side of the main body; and a member constituting the height adjustment mechanism to which other ends of the first link and the second link are pivotally attached, and the seat link mechanism comprises:

a fourth link, one end of which is coupled to the one end of the second link to move in interlock with rotating motion of the second link, and an other end of which is pivotally attached to a front end side of the seat; and a fifth link, one end of which is pivotally attached further backward on a top surface of the main body than the fourth link, and an other end of which is pivotally attached to a back end side of the seat, the fifth link being configured to rotate with the fourth link and to raise the seat when the fourth link rotates in interlock with the second link of the leg link mechanism.

7. The wheelchair of claim 1, wherein the leg link mechanism is configured to lower the footrest from a lifted-up position to a grounded position while moving the footrest in a direction in which the footrest approaches a front of the main body, and the seat link mechanism is configured to raise the seat while moving the seat toward the front of the main body.

8. The wheelchair of claim 1, wherein the brake mechanism comprises:

a slide link comprising an engagement member at one end, the slide link being provided to be slidable along a back-and-forth direction of the main body;

a rotation link, one end of which is rotatably provided in the main body, and an other end of which engages with the engagement member provided at the one end of the slide link, the rotation link being configured to rotate in interlock with a sliding motion of the slide link;

a brake link, one end of which is rotatably provided in the main body, and an other end of which is provided with a brake member configured to press the wheel and inhibit the wheel from rotating;

a first interlock link, one end of which is integrally provided at the one end of the rotation link, which is a rotation fulcrum;

a second interlock link, one end of which is pivotally attached to an intermediate part of the brake link, and an other end of which is pivotally attached to an other end of the first interlock link, the second interlock link being configured to transmit rotating motion of the rotation link to the brake link via the first link; and a transmission means configured to, when the seat is raised from the lowered position and the seat link mechanism is worked, transmit movement of the seat link mechanism to the brake link via the slide link, the rotation link, and the first and second interlock links, and press the brake member against the wheel by rotating the brake link.

9. The wheelchair of claim 1, further comprising

An urging means configured to elastically urge the seat link mechanism in a direction in which the seat is raised.

10. The wheelchair of claim 9, wherein the urging means is configured to raise the seat by moving the seat link mechanism when a load on the seat is removed.

* * * * *